US008037877B2

(12) United States Patent
Liao

(10) Patent No.: US 8,037,877 B2
(45) Date of Patent: Oct. 18, 2011

(54) BARREL FOR PROHIBITING PAINTBALL FROM DROPPING THEREFROM

(75) Inventor: Sheng-Jen Liao, Fongyuan (TW)

(73) Assignee: Yao-Gwo Gan, Taichung (TW)

( * ) Notice: Subject to any disclaimer, the term of this patent is extended or adjusted under 35 U.S.C. 154(b) by 408 days.

(21) Appl. No.: 12/343,628

(22) Filed: Dec. 24, 2008

(65) Prior Publication Data

US 2010/0154764 A1 Jun. 24, 2010

(51) Int. Cl.
*F41B 11/00* (2006.01)

(52) U.S. Cl. ..... 124/44.7; 124/1; 124/41.1; 124/56; 124/71; 124/73; 124/81; 124/82; 124/83; 124/84; 124/85; 42/76.01

(58) Field of Classification Search ..... 124/1, 41.1, 124/44.7, 56, 71, 73, 81–85; 42/76.01
See application file for complete search history.

(56) References Cited

U.S. PATENT DOCUMENTS 2,182,369 A * 12/1939 Barron ..... 124/81
3,236,521 A * 2/1966 Knott ..... 473/457
3,472,218 A * 10/1969 Mers ..... 124/67
3,584,614 A * 6/1971 Horvath ..... 124/56
3,662,729 A * 5/1972 Henderson ..... 124/73
3,756,001 A * 9/1973 Macidull ..... 56/328.1
3,765,396 A * 10/1973 Kienholz et al. ..... 124/65
3,897,061 A * 7/1975 Grattan ..... 473/511
4,674,470 A * 6/1987 Tsukiji ..... 124/74
5,071,123 A * 12/1991 Spector ..... 473/307
5,113,842 A * 5/1992 Moormann ..... 124/65
5,115,794 A * 5/1992 Moormann ..... 124/65
5,349,938 A * 9/1994 Farrell ..... 124/73
5,450,838 A * 9/1995 Nakahigashi et al. ..... 124/56
5,505,188 A * 4/1996 Williams ..... 124/74
5,515,838 A * 5/1996 Anderson ..... 124/76
5,572,982 A * 11/1996 Williams ..... 124/74
5,655,510 A * 8/1997 Kunimoto ..... 124/81
5,823,173 A * 10/1998 Slonaker et al. ..... 124/56
6,295,752 B1 * 10/2001 Havlock ..... 42/76.01
6,453,593 B1 * 9/2002 Dillon ..... 42/76.01
6,655,372 B1 * 12/2003 Field et al. ..... 124/83
6,668,815 B1 * 12/2003 Fernandez ..... 124/83
6,857,423 B2 * 2/2005 Jong ..... 124/79
7,017,569 B2 * 3/2006 Jong ..... 124/52
7,076,905 B2 * 7/2006 Zouboulakis ..... 42/76.01
7,603,998 B2 * 10/2009 Finstad ..... 124/81
7,624,723 B2 * 12/2009 Gardner et al. ..... 124/1
7,686,003 B2 * 3/2010 Witzigreuter ..... 124/65
7,708,002 B2 * 5/2010 Gerardo ..... 124/73
7,765,998 B2 * 8/2010 Kaakkola et al. ..... 124/71
7,770,571 B2 * 8/2010 Tippmann et al. ..... 124/73
7,775,200 B2 * 8/2010 Anderson ..... 124/83

(Continued)

*Primary Examiner* — Gene Kim
*Assistant Examiner* — Alexander Niconovich

(57) ABSTRACT

A barrel for prohibiting the paintball from dropping therefrom is provided by the present invention. The barrel includes a main body and an elastic ring. In which, a rear end of the main body is formed with a combining portion to combine with a paintball gun, and an extension is extended rearward from the combining portion. A bore penetrates through the main body, the combining portion and the extension. Around an outer periphery of the extension is disposed an annular groove, and at least one slot is formed in the annular groove, while the slot communicating the bore proximate to the extension. In addition, the elastic ring has a smaller perimeter than that of the annular groove. The elastic ring is disposed in the annular groove, and a part of the elastic ring sinks into the slot, overlapping a part of the bore.

6 Claims, 4 Drawing Sheets

U.S. PATENT DOCUMENTS

| | | | | |
|---|---|---|---|---|
| 7,793,644 | B2 * | 9/2010 | Lai | 124/77 |
| 7,866,308 | B2 * | 1/2011 | Jones et al. | 124/71 |
| 2002/0078616 | A1 * | 6/2002 | Perry et al. | 42/76.01 |
| 2002/0112391 | A1 * | 8/2002 | Dillon | 42/76.01 |
| 2005/0091901 | A1 * | 5/2005 | Perry et al. | 42/78 |
| 2006/0065260 | A1 * | 3/2006 | Judson | 124/83 |
| 2006/0191525 | A1 * | 8/2006 | Dai | 124/83 |
| 2007/0125351 | A1 * | 6/2007 | Campo et al. | 124/56 |
| 2008/0078370 | A1 * | 4/2008 | Kaakkola et al. | 124/73 |
| 2010/0051004 | A1 * | 3/2010 | Lian | 124/1 |
| 2010/0154766 | A1 * | 6/2010 | Skilling | 124/71 |
| 2011/0000474 | A1 * | 1/2011 | Wood | 124/73 |

* cited by examiner

BARREL FOR PROHIBITING PAINTBALL FROM DROPPING THEREFROM

FIELD OF THE INVENTION

The present invention relates to a barrel of a paintball gun, which can prohibit the paintball from dropping therefrom.

DESCRIPTION OF THE PRIOR ART

The barrel and the breech of a conventional paintball gun are combined by the threaded means. And the conventional paintball guns of both open-bolt type and closed-bolt type have the disadvantage: whenever a paintball is loaded in the breech without projecting at once, the paintball is very possible to slide within or even drop out of the barrel, which troubles the users a lot.

Practically, the afore mentioned disadvantage is mitigated by installing a barrel with a bore diameter slightly smaller that the average diameter of the paintball. However, The narrowed barrel increase the friction to the projectile, so that the projection range is seriously reduced. What is worth, the paintball could possibly be stuck in the barrel or even cracked due to the size error of the paintball.

Therefore, the present invention has arisen to mitigate and/or obviate the afore-described disadvantages.

SUMMARY OF THE INVENTION

The primary object of the present invention is to provide a barrel for prohibiting the paintball from dropping therefrom before projection.

To achieve the above object, the barrel provided by the present invention includes a main body and an elastic ring. In which, a rear end of the main body is formed with a combining portion to combine with a paintball gun, and an extension is extended rearward from the combining portion. A bore penetrates through the main body, the combining portion and the extension.

Around an outer periphery of the extension is radially recessed to be formed with an annular groove, and at least one non-circular slot is formed in the annular groove, while the slot communicating the annular groove to the bore proximately. In addition, the elastic ring has a perimeter smaller than that of the annular groove. The elastic ring is disposed in the annular groove, and a part of the elastic ring sinks into the slot and is received in the bore.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
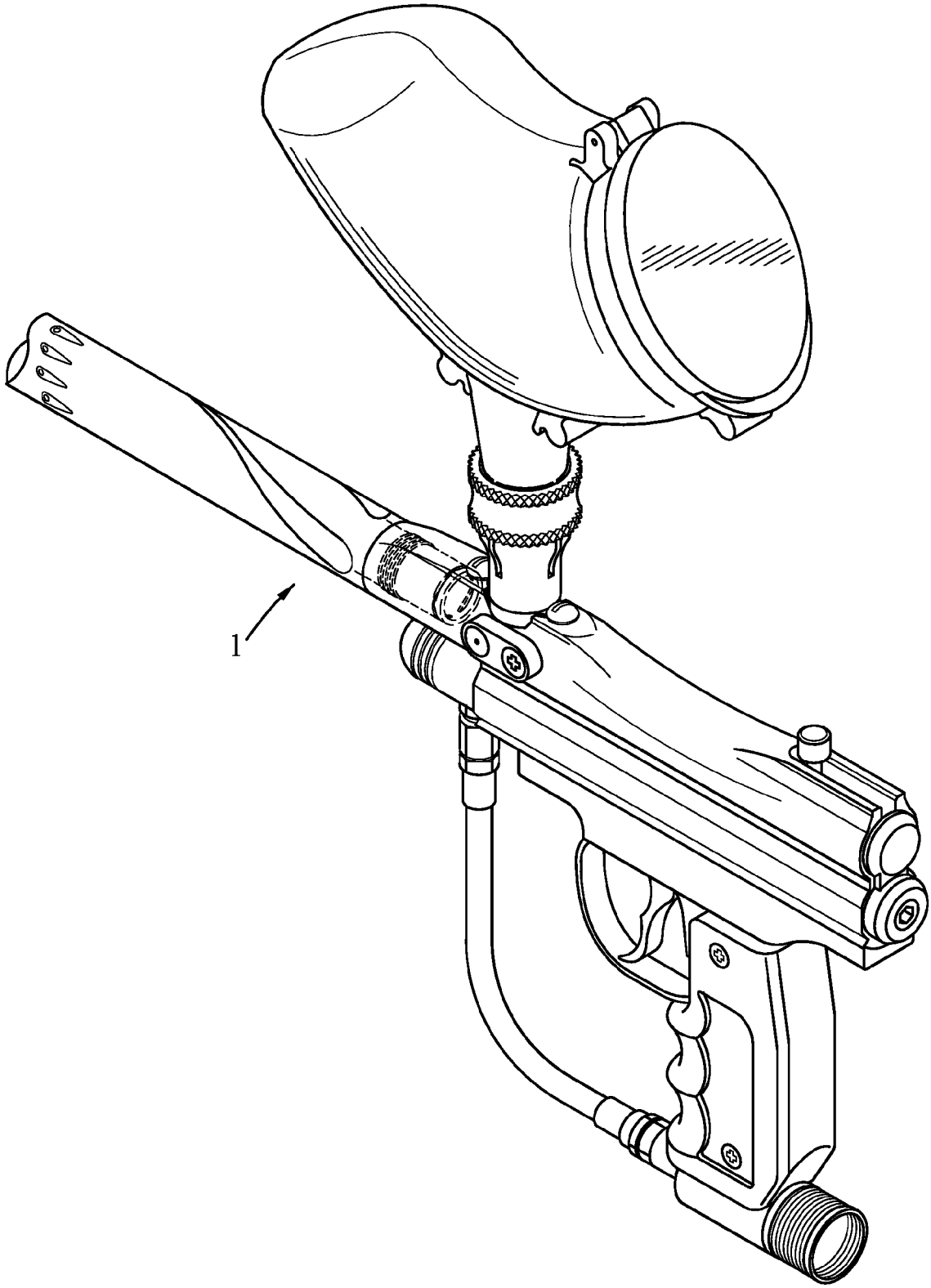
FIG. 1 is a drawing showing a barrel of the present invention combining with a breech of the conventional paintball gun.

Please refer to FIG. 1, the paintball gun includes a breech, and in the front of the breech is formed with a paintball loading hole. A portion in front of the loading hole is a first combining portion to combine with a barrel, i.e. a barrel 1 of the present invention.

Figure 2:
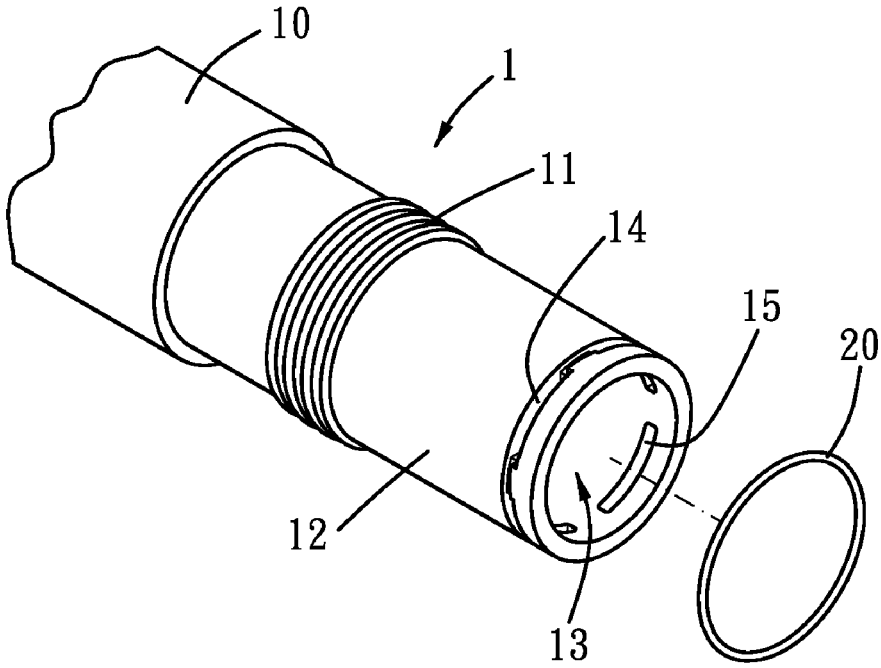
FIG. 2 is a partial explosive drawing of a barrel in accordance with the first embodiment of the present invention.
Figure 3:
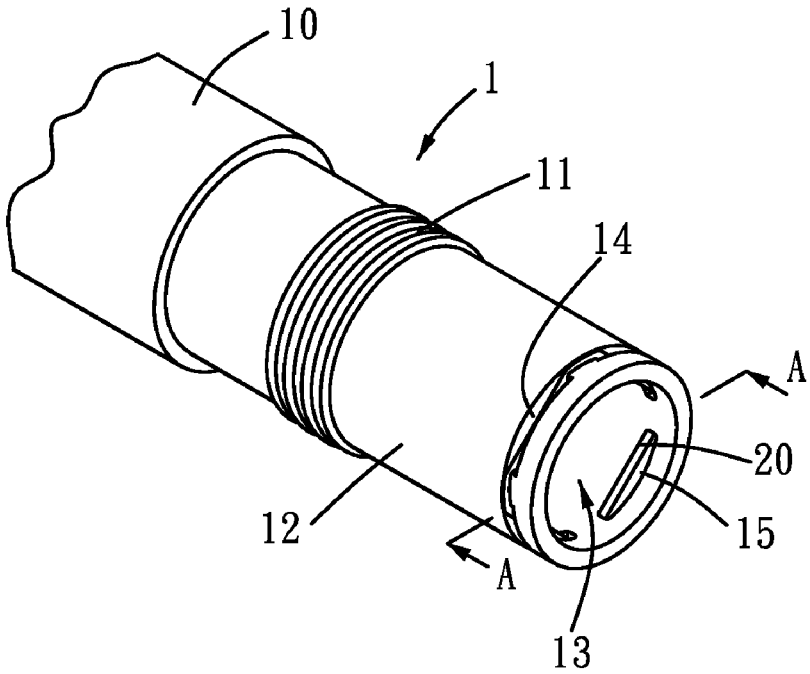
FIG. 3 is a partial diagram showing a barrel in accordance with the first embodiment of the present invention.

Please refer to FIG. 2 and FIG. 3. The barrel 1 of the present invention includes a main body 10 and an elastic ring 20. A rear end of the main body 10 is formed with a second combining portion 11 to combine with the first combining portion of the breech. An outer periphery of the combining portion 11 is formed with a threaded section, so as to be screwed onto the breech. An extension 12 with a smaller outer diameter than that of the main body 10 is extended rearward from the combining portion 11. A bore 13 penetrates the main body 10, the combining portion 11 and the extension 12.

Around an outer periphery of the extension 12 is radially recessed to be formed with an annular groove 14 in which at least one non-circular slot 15 is formed, and the slot 15 communicates the annular groove 14 to the bore 13 proximately. Though the slot 15 is formed non-circularly, a plurality of slots may still be annularly arranged around the bore 13, as shown in figures. In addition, a perimeter of the elastic ring 20 is slightly smaller than that of the annular groove 14. The elastic ring 20 is disposed in the annular groove 14, and a part of the elastic ring 20 sinks into the slot 15 and is received in the bore 13. In other words, the elastic ring 20 is partially inserted and received in the bore 13 via the slot 15 from the annular groove 14. Since the elastic ring 20 is gradually inserted in the slot 15 and the bore 13 in a circular route, the insertion is described as sinking.

Figure 3A:
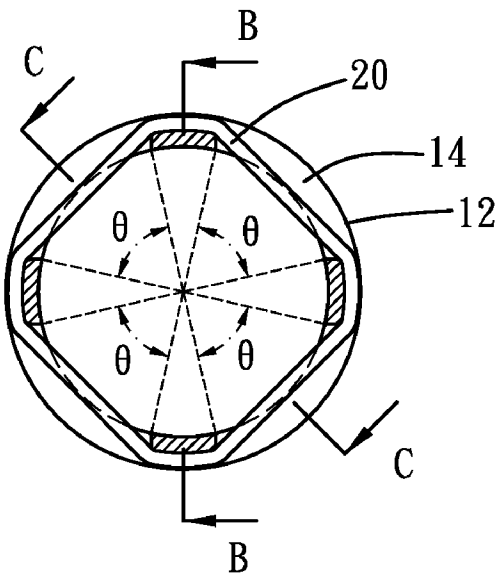
FIG. 3A is an AA profile of FIG. 3.
Figure 3B:
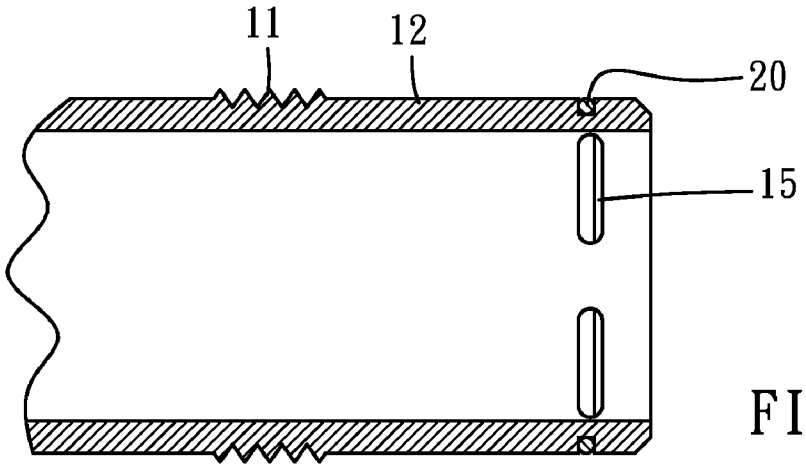
FIG. 3B is a BB profile of FIG. 3A.
Figure 3C:
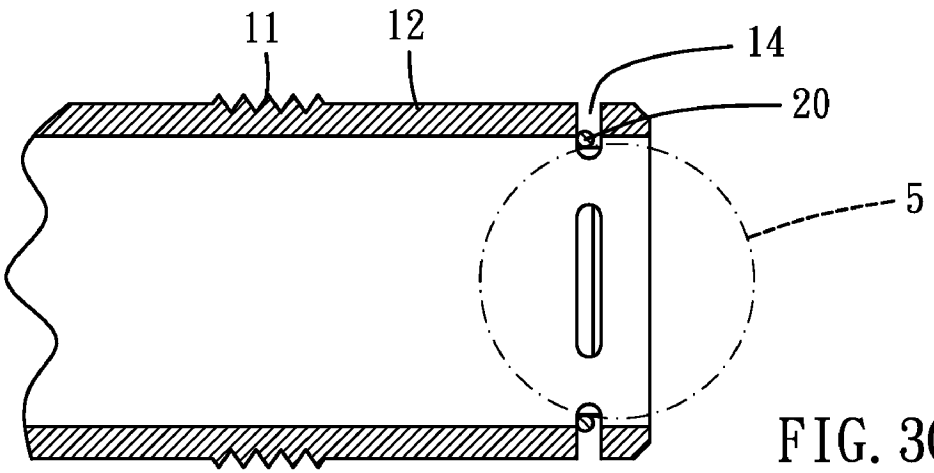
FIG. 3C is a CC profile of FIG. 3A.

Next, please refer to FIG. 3A to FIG. 3C. In the present invention, each slot 15 has a central angle x of 50 degrees to 70 degrees. When the central angle x is between 50 degrees to 70 degrees, the elastic ring 20 and the bore have the most suitable overlapping ratio so as to achieve desired paintball prohibiting effect. If the angle x is smaller than 50 degrees, the overlapping ratio of the elastic ring 20 to bore 13 is insufficient or they may not overlap at all, such that the paintball can still drop out of the barrel before projection. And if the angle x is bigger than 70 degrees, the elastic ring 20 is then oversunk into the slot 15 so that the bore 13 is jammed.

In the present embodiment, each of four slots 15 is formed spaced apart with others in the annular groove 14. That is, the elastic ring 20 can sink into the bore 13 uniformly around its periphery, providing better prohibiting effect. Moreover, sufficient mechanical strength of the annular groove 14 is maintained as well. If there are more than four slots 15 formed in the annular groove 14, the mechanical strength of the extension 12 will be insufficient, and the extension 12 will be so fragile that it may break easily.

Figure 4:
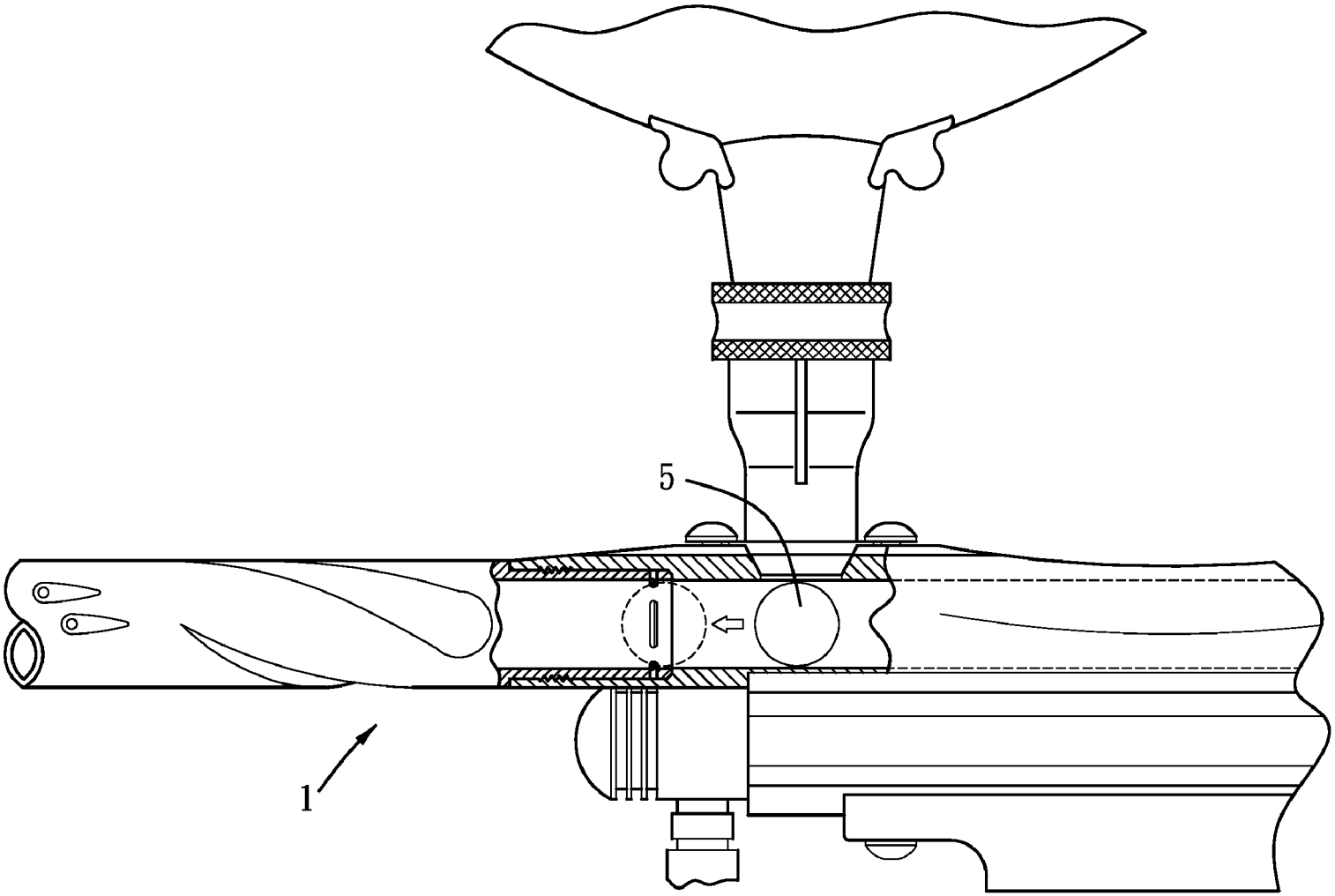
FIG. 4 is a drawing showing the function of a barrel in accordance with the second embodiment of the present invention.

Furthermore, Please refer to FIG. 3C and FIG. 4 simultaneously. When a paintball 5 is loaded from the loading hole, it will prohibited from dropping out by the elastic ring 20, even if it slides frontward. In addition, smoother projection is performed due to the un-narrowed barrel of the present invention.

Based on the above-mentioned description, it is readily understood that the barrel of the present invention can realize the efficacy listed as follow:

1. The barrel of the present invention can prohibit the paintball from dropping before projection. In addition, it is not necessary to choose a barrel with a smaller bore diameter, which reduces projection range, as prior art does. Therefore, the present invention has actually obviated the afore-described disadvantages.
2. The barrel is removable from the breech, so that it is convenient to dispose the annular groove, slots and the elastic ring thereon, in contrast to the difficult manufacture process of forming those on an interior of the breech.
3. Due to the simplified manufacture process of the present invention, the manufacture cost is perfectly controlled while providing great paintball prohibiting effect, such that a higher effect/cost ratio is achieved.

While we have shown and described various embodiments in accordance with the present invention, it should be clear to those skilled in the art that further embodiments may be made without departing from the scope of the present invention.

What is claimed is:

1. A barrel for a paintball gun, comprising:

a main body, a rear end thereof being formed with a combining portion to combine with a paintball gun, an extension being extended rearward from the combining portion, an outer diameter of the extension is smaller than that of the main body, a bore penetrating through the main body, the combining portion and the extension, around an outer periphery of the extension being radially recessed to be formed with an annular groove, and at least one non-circular slot being formed in the annular groove, the slot communicating the annular groove to the bore proximately; and an elastic ring with a perimeter smaller than a perimeter of the annular groove, the elastic ring being disposed in the annular groove, and a part of the elastic ring sinking into the slot and being received in the bore.

2. The barrel according to claim 1, wherein the slot has a central angle of 50 degrees to 70 degrees.

3. The barrel according to claim 2, wherein four slots are formed spaced apart with each other in the annular groove.

4. The barrel according to claim 1, wherein an outer periphery of the combining portion is formed with a threaded section.

5. The barrel according to claim 2, wherein an outer periphery of the combining portion is formed with a threaded section.

6. The barrel according to claim 3, wherein an outer periphery of the combining portion is formed with a threaded section.

* * * * *